US006407725B1

(12) United States Patent
Song

(10) Patent No.: US 6,407,725 B1
(45) Date of Patent: Jun. 18, 2002

(54) APPARATUS FOR DETECTING OVER CURRENT IN PLASMA DISPLAY PANEL

(75) Inventor: Yu-jin Song, Cheonan (KR)

(73) Assignee: Samsung SDI Co., Ltd., Suwon City (FR)

( * ) Notice: Subject to any disclaimer, the term of this patent is extended or adjusted under 35 U.S.C. 154(b) by 193 days.

(21) Appl. No.: 09/624,332

(22) Filed: Jul. 24, 2000

(30) Foreign Application Priority Data

Jul. 29, 1999 (KR) ..... 99-31046

(51) Int. Cl.[7] ..... G09G 3/28
(52) U.S. Cl. ..... 345/60; 345/63; 345/904
(58) Field of Search ..... 345/60, 63, 904; 363/20, 56, 17, 21

(56) References Cited

U.S. PATENT DOCUMENTS 4,347,509 A * 8/1982 Hardway et al. ..... 340/778
5,621,623 A * 4/1997 Kuriyama et al. ..... 363/20
5,694,030 A * 12/1997 Sato et al. ..... 323/282

* cited by examiner

*Primary Examiner*—Richard Hjerpe
*Assistant Examiner*—Jennifer T. Nguyen
(74) *Attorney, Agent, or Firm*—Leydig, Voit & Mayer, Ltd.

(57) ABSTRACT

An apparatus for detecting lowering of at least first and second output voltages from a driving apparatus of a plasma display panel below corresponding regular voltages due to over current in the plasma display panel and generating an output control signal to be transmitted to the driving apparatus, includes a switching transistor having a collector to which a bias voltage is applied, an emitter which is grounded, and a base, the switching transistor being operated according to the level of a voltage applied to the base and generating the output control signal through the collector. A voltage signal generating portion is connected between the base of the switching transistor and a port of the first output voltage, and the base and a port of the second output voltage, respectively, for changing a bias voltage of the base as the first and second output voltages change. A switching support portion is connected between the emitter of the switching transistor and at least one of the first and second output ports, so that a lowered voltage is applied to the emitter when at least one of the first and second output voltages is lower than a corresponding regular voltage, to prevent incorrect operation of the switching transistor.

5 Claims, 2 Drawing Sheets

APPARATUS FOR DETECTING OVER CURRENT IN PLASMA DISPLAY PANEL

BACKGROUND OF THE INVENTION

1. Field of the Invention

The present invention relates to an apparatus for detecting over current in a plasma display panel, and more particularly, to an apparatus for detecting lowering of at least first and second output voltages from a driving apparatus of a plasma display panel below a corresponding regular voltage due to over current in the plasma display panel and generating an output control signal to be transmitted to the driving apparatus.

2. Description of the Related Art

FIG. 1 shows an apparatus for detecting over current in a conventional plasma display panel. Referring to the drawing, a first output voltage Vo1 input to a first input port 11, the level of which is dropped by resistors R101, R102, R103 and R104, is input to a negative input port (−) of a first comparator Co1. The first comparator Co1 generates an output control signal in a high state indicating that there is an over current flow in a plasma display panel (not shown) when the input first output voltage Vo1 is lower than a first reference voltage Vref1. Also, the first comparator Co1 generates an output control signal in a low state indicating that there is a normal current flow in the plasma display panel when the input first output voltage Vo1 is higher than or equal to the first reference voltage Vref1. The output control signal generated from the first comparator Co1 is input to a driving apparatus (not shown) of the plasma display panel via a diode D11 and a control output port SC. Devices D13, R109, ZD11, ZD12 and ZD13 connected in series between the first input port 11 and the control output port SC protect a circuit by allowing a first output voltage Vo1 at an upper limit level only to be input when the first output voltage Vo1 becomes abnormally high. Reference numeral G denotes a ground port.

Likewise, a second output voltage Vo2 input to a second input port 12, the level of which is dropped by resistors R105, R105, R107 and R108, is input to a negative input port (−) of a second comparator Co2. The second comparator Co2 generates an output control signal in a high state indicating that over current flows in the plasma display panel when the input second output voltage Vo2 is lower than a second reference voltage Vref2. Also, the second comparator Co2 generates an output control signal in a low state indicating that there is a normal current flow in the plasma display panel when the input second output voltage Vo2 is higher than or equal to the second reference voltage Vref2. The output control signal generated from the second comparator Co2 is input to the driving apparatus of the plasma display panel via a diode D12 and the control output port SC. Devices D14, D15, ZD15, ZD16, ZD17, ZD18, R110 and D16 connected in series between the second input port 12 and the control output port SC protect the circuit by allowing a second output voltage Vo2 at an upper limit level only to be input when the second output voltage Vo2 becomes abnormally high.

The conventional over current detecting apparatus has the following problems as it uses the comparators with respect to each of the output voltages Vo1 and Vo2.

First, as transmission delay time of each of the comparators Co1 and Co2 is relatively long, the over current flowing in the plasma display panel cannot be detected rapidly.

Second, as each of the output voltages Vo1 and Vo2 is compared separately, it is not suitable for a plasma display panel having various levels of driving voltages.

Third, as the reference voltages Vref1 and Vref2 of the comparators Co1 and Co2 must be accurately generated, the configuration of a circuit of the apparatus becomes relatively complicated.

SUMMARY OF THE INVENTION

To solve the above problems, it is an objective of the present invention to provide an apparatus for rapidly detecting over current flowing in a plasma display panel with simple circuitry even when there are various levels of the driving voltage in the plasma display panel.

Accordingly, to achieve the above objective, there is provided an apparatus for detecting lowering of at least first and second output voltages from a driving apparatus of a plasma display panel than a corresponding regular voltage due to over current in the plasma display panel and generating an output control signal to be transmitted to the driving apparatus, which comprises a switching transistor having a collector to which a bias voltage of a positive polarity is applied, an emitter which is grounded, and a base, the switching transistor being operated according to the level of a voltage applied to the base and generating the output control signal through the collector, a voltage signal generating portion connected between the base of the switching transistor and a port of the first output voltage, and the base and a port of the second output voltage, respectively, for changing a bias voltage of the base as the first and second output voltages change, and a switching support portion connected between the emitter of the switching transistor and at least any one of the first and second output ports, for allowing a lowered voltage to be applied to the emitter when at least any one of the first and second output voltages is lower than a corresponding regular voltage, to thus prevent incorrect operation of the switching transistor.

The effects of the present invention are as follows.

First, as a switching transistor is used, the transmission delay time is relatively short so that over current flowing in the plasma display panel can be rapidly detected.

Second, as the output voltages for driving the plasma display panel are integrally monitored by the switching transistor, the over current detecting apparatus is suitable for a plasma display panel having various levels of a driving voltage.

Third, a reference voltage for comparison need not be generated as the switching transistor is used. Thus, the configuration of the apparatus becomes relatively simple.

Fourth, as incorrect operation of the switching transistor is prevented by the switching support portion, detecting over current can be performed more accurately.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
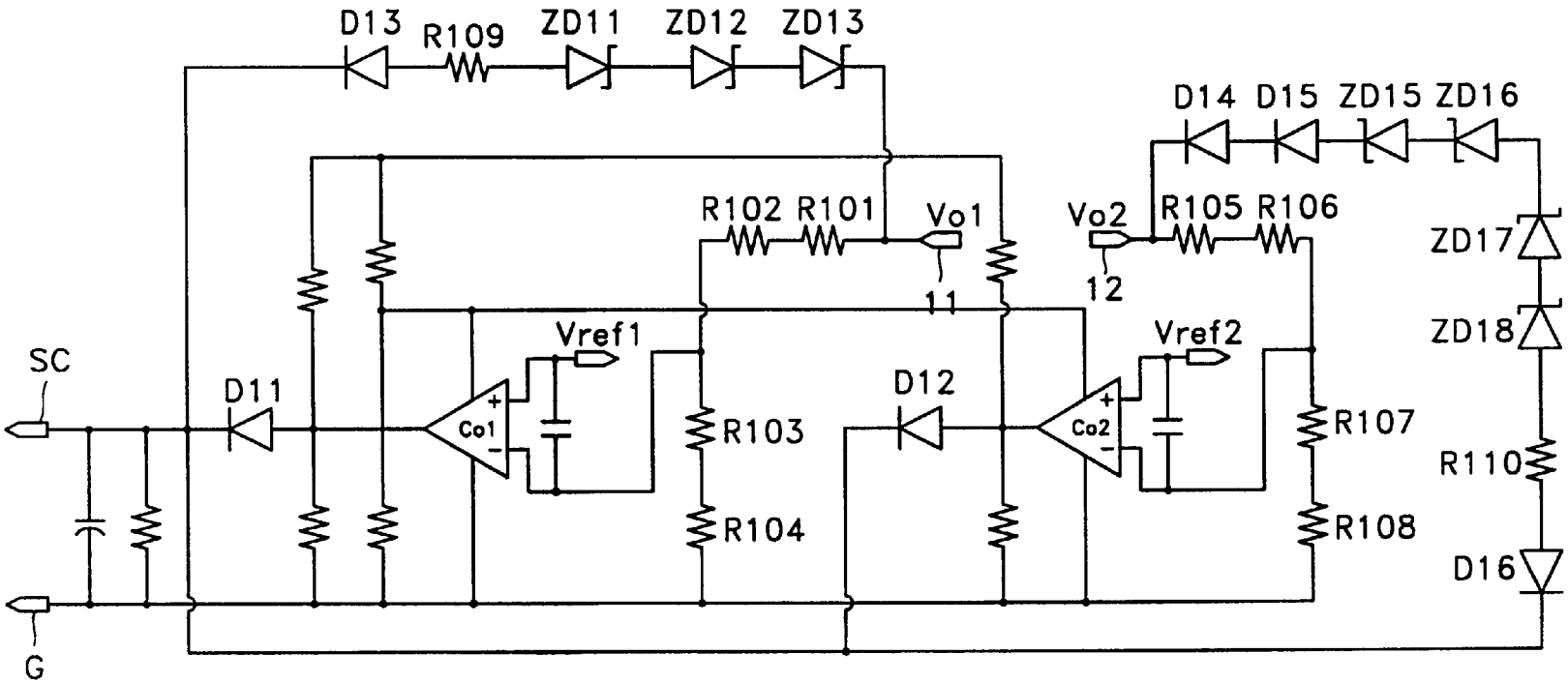
FIG. 1 (PRIOR ART)
FIG. 1 is a circuit diagram showing a conventional apparatus for detecting over current in a plasma display panel.
Figure 2:
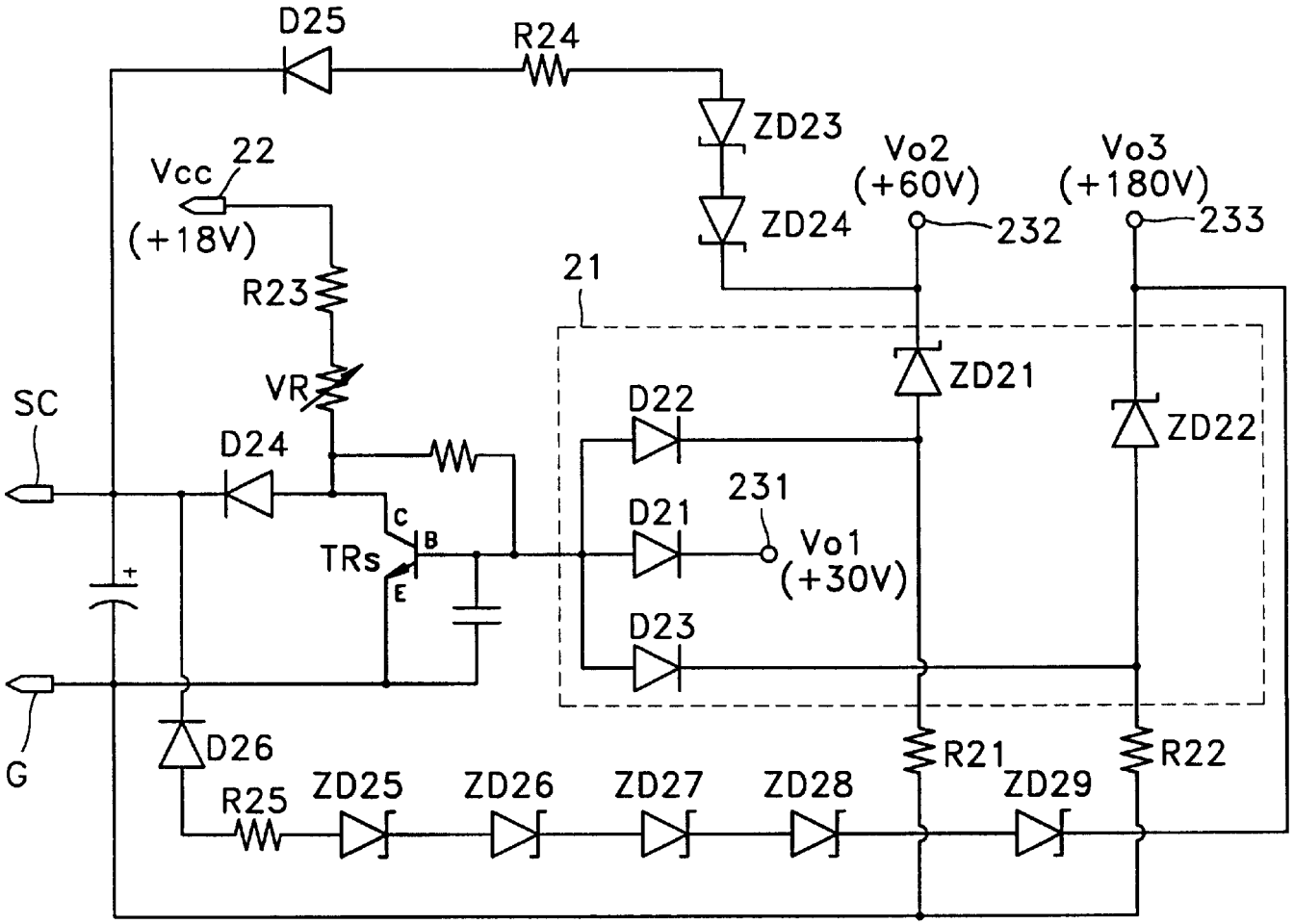
FIG. 2 is a circuit diagram showing an apparatus for detecting over current in a plasma display panel according to a preferred embodiment of the present invention.

Referring to FIG. 2, an apparatus for detecting over current according to the present invention detects lowering of first, second and third output voltages Vo1, Vo2 and Vo3 from a driving apparatus (not shown) of a plasma display panel below a corresponding regular voltage due to over current in the plasma display panel and generating an output control signal transmitted to the driving apparatus. The over current detecting apparatus includes a switching transistor TRs, a voltage signal generating portion 21, and switching support portions ZD21, ZD22, R21 and R22. Here, the switching transistor TRs is an NPN bipolar transistor.

Bias voltage Vcc of +18 V applied to a bias power port 22 is dropped in passing through resistors R23 and VR and the dropped bias voltage is applied to the collector C of the switching transistor TRs. The emitter E of the switching transistor TRs is grounded through a ground port G. The switching transistor TRs, which is operated according to the level of the voltage applied to the emitter E, generates an output control signal through the collector C. The generated output control signal is input to the driving apparatus of the plasma display panel through a diode D24 and a control output port SC.

The voltage signal generating portion 21 includes a first diode D21, a second diode D22, a third diode D23, a first Zener diode ZD21, and a second Zener diode ZD22. The anode of the first diode D21 is connected to the base B of the switching transistor TRs and the cathode of the first diode D21 is connected to a port 231 of the first output voltage Vo1. The anode of the second diode D22 is connected to the base B of the switching transistor TRs. The anode of the first Zener diode ZD21 is connected to the cathode of the second diode D22 and the cathode of the first Zener diode ZD21 is connected to a port 232 of the second output voltage Vo2. The first Zener diode ZD21 applies a voltage corresponding to the second output voltage Vo2 to the cathode of the second diode D22. The anode of the third diode D23 is connected to the base B of the switching transistor TRs. The cathode of the second Zener diode ZD22 is connected to a port 233 of the third output voltage Vo3. The second Zener diode ZD22 applies a voltage corresponding to the third output voltage Vo3 to the cathode of the third diode D23.

As above, the voltage signal generating portion 21 is connected between the base B of the switching transistor TRs and the port 231 of the first output voltage Vo1, the base B of the switching transistor TRs and the port 232 of the second output voltage Vo2, and the base B of the switching transistor TRs and the port 233 of the third output voltage Vo3, respectively. The voltage signal generating portion 21 changes a bias voltage of the base B of the switching transistor TRs as the first, second and third output voltages Vo1, Vo2 and Vo3 change.

A switching support portion consisting of ZD21, ZD22, R21 and R22 is connected between the ports 232 and 233 of the second and third output voltages, which are relatively high, and the emitter E of the switching transistor TRs. That is, the switching support portion (ZD21, ZD22, R21 and R22) includes resistors R21 and R22 and the Zener diodes ZD21 and ZD22 for setting voltages. The resistors R21 and R22 are connected between the anodes of the Zener diodes ZD21 and ZD22 and the emitter E of the switching transistor Trs.

In the operation of the switching support portion (ZD21, ZD22, R21 and R22), when at least one of the second and third output voltages Vo2 and Vo3 becomes lower than the regular voltage, the Zener diodes ZD21 and ZD22 corresponding thereto are turned on in a forward direction. When the Zener diodes Zd21 and ZD22 are turned on in the forward direction, as a lowered voltage of the second and third output voltages Vo2 and Vo3 is applied to the emitter E of the switching transistor TRs, the electric potential of the emitter E of the switching transistor TRs becomes higher than that of the base B of the switching transistor TRs. Accordingly, the turn-off operation of the switching transistor TRs can be accurately performed so that incorrect operation of the switching transistor TRs can be prevented.

The devices D25, R24, ZD23 and ZD24 connected in series between the second input port 232 and the control output port SC protect the circuit by allowing the second output voltage Vo2 having a level of an upper limit only to be input only when the second output voltage Vo2 becomes abnormally high. Likewise, the devices D26, R25, ZD25, ZD26, ZD27, ZD28 and ZD29 connected in series between the third input port 233 and the control output port SC protect the circuit by allowing the third output voltage Vo3 having a level of an upper limit only to be input only when the third output voltage Vo3 becomes abnormally high.

As described above, the apparatus for detecting over current in a plasma display panel according to the present invention has the following effects.

First, as a switching transistor is used, the transmission delay time is relatively short so that over current flowing in the plasma display panel can be rapidly detected.

Second, as the output voltages for driving the plasma display panel are integrally monitored by the switching transistor, the over current detecting apparatus is suitable for a plasma display panel having various levels of driving voltage.

Third, a reference voltage for comparison need not be generated since the switching transistor is used. Thus, the configuration of the apparatus becomes relatively simple.

Fourth, as incorrect operation of the switching transistor is prevented by the switching support portion, detecting over current can be performed more accurately.

It is noted that the present invention is not limited to the preferred embodiment described above, and it is apparent that variations and modifications by those skilled in the art can be effected within the spirit and scope of the present invention defined in the appended claims.

What is claimed is:

1. An apparatus for detecting lowering of at least one of first and second output voltages from a driving apparatus of a plasma display panel below a corresponding threshold voltage due to excessive current flow in the plasma display panel and generating an output control signal transmitted to the driving apparatus, the apparatus for detecting comprising:

a switching transistor having a collector to which a bias voltage is applied, an emitter which is grounded, and a base, the switching transistor being operated according to a voltage applied to the base and generating an output control signal through the collector;

a voltage signal generating portion connected between the base of the switching transistor and a port of a first output voltage produced by a plasma display panel driving apparatus, and between the base and a port of a second output voltage produced by the plasma display panel driving apparatus, respectively, for changing a bias voltage applied to the base as the first and second output voltages change; and a switching support portion connected between the emitter of the switching transistor and at least one of the ports of the first and second output voltages, for applying a lowered voltage to the emitter when at least one of the first and second output voltages is lower than a corresponding threshold voltage, preventing incorrect operation of the switching transistor.

2. An apparatus for detecting lowering of at least one of first and second output voltages from a driving apparatus of a plasma display panel below a corresponding threshold voltage due to excessive current flow in the plasma display panel and generating an output control signal transmitted to the driving apparatus, the apparatus for detecting comprising:

a switching transistor having a collector to which a bias voltage is applied, an emitter which is grounded, and a base, the switching transistor being operated according to a voltage applied to the base and generating an output control signal through the collector;

a voltage signal generating portion connected between the base of the switching transistor and a port of a first output voltage produced by a plasma display panel driving apparatus, and between the base and a port of a second output voltage produced by the plasma display panel driving apparatus, respectively, for changing a bias voltage applied to the base as the first and second output voltages change, the voltage signal generating portion comprising a diode and a Zener diode connected in series between the base of the switching transistor and one of the ports of the first and second output voltages; and a switching support portion connected between the emitter of the switching transistor and the voltage signal generating portion for application a lowered voltage to the emitter when at least one of the first and second output voltages is lower than a corresponding threshold voltage, preventing incorrect operation of the switching transistor.

3. The apparatus according to claim 2 wherein the switching support portion comprises a resistor connected between a junction of the diode and the Zener diode and the emitter of the switching transistor.

4. An apparatus for detecting lowering of at least one of first and second output voltages from a driving apparatus of a plasma display panel below a corresponding threshold voltage due to excessive current flow in the plasma display panel and generating an output control signal transmitted to the driving apparatus, the apparatus for detecting comprising:

a switching transistor having a collector to which a bias voltage is applied, an emitter which is grounded, and a base, the switching transistor being operated according to a voltage applied to the base and generating an output control signal through the collector;

a voltage signal generating portion connected between the base of the switching transistor and a port of a first output voltage produced by a plasma display panel driving apparatus, and between the base and a port of a second output voltage produced by the plasma display panel driving apparatus, respectively, for changing a bias voltage applied to the base as the first and second output voltages change, the voltage signal generating portion comprising a first diode and a first Zener diode connected in series between the base of the switching transistor and the port of the first output voltage, and a second diode and a second Zener diode connected in series between the base of the switching transistor and the port of the second output voltage; and a switching support portion connected between the emitter of the switching transistor and the ports of the first and second output voltages for applying a lowered voltage to the emitter when at least one of the first and second output voltages is lower than a corresponding threshold voltage, preventing incorrect operation of the switching transistor.

5. The apparatus according to claim 4 wherein the switching support portion comprises a first resistor connected between the emitter of the switching transistor and a junction of the first diode and the first Zener diode, and a second resistor connected between the emitter of the switching transistor and a junction of the second diode and the second Zener diode.

* * * * *